United States Patent [19]

Komatsu

[11] Patent Number: 4,571,792

[45] Date of Patent: Feb. 25, 1986

[54] METHOD OF TREATING WARP YARN ENDS IN A SIZING PROCESS

[75] Inventor: Tokuji Komatsu, Kanazawa, Japan

[73] Assignee: Tsudakoma Corp., Ishikawa, Japan

[21] Appl. No.: 609,256

[22] Filed: May 11, 1984

[30] Foreign Application Priority Data

May 16, 1983 [JP] Japan ..... 58-085653

[51] Int. Cl.[4] ..... D02H 5/02

[52] U.S. Cl. ..... 28/180; 28/181; 28/183; 28/198

[58] Field of Search ..... 28/180, 181, 182, 183, 28/198, 199, 208, 212, 179

[56] References Cited

U.S. PATENT DOCUMENTS

| | | | |
|---|---|---|---|
| 1,948,646 | 2/1934 | Bruenn | 28/180 |
| 2,250,728 | 7/1941 | Sherrill | 28/199 |
| 2,344,721 | 3/1944 | O'Connor | 28/181 |
| 2,579,322 | 12/1951 | Keith et al. | 28/198 |
| 3,164,883 | 1/1965 | Fleischer et al. | 28/199 |
| 3,678,548 | 7/1972 | Largeron et al. . | |
| 4,417,374 | 11/1983 | Kuroda et al. . | |

FOREIGN PATENT DOCUMENTS

| | | | |
|---|---|---|---|
| 1460334 | 2/1969 | Fed. Rep. of Germany | 28/179 |
| 1042156 | 6/1953 | France | 28/212 |
| 23057 | of 1896 | United Kingdom | 28/212 |

*Primary Examiner*—Robert R. Mackey

*Attorney, Agent, or Firm*—Flynn, Thiel, Boutell & Tanis

[57] ABSTRACT

The ends of warp yarns in a sheet form are treated at the end of a sizing process in preparation for a subsequent rewinding process. In the sizing process, the warp yarns are threaded through a reed with at least two warp yarns in each reed dent in vertically spaced relation. The at least two warp yarns are threaded through one dent in a reed in the rewinding process. Heretofore, it has been tedious and time-consuming to thread the warp yarns through the reeds since the warp yarns in one reed dent cannot be distinguished from those in other reed dents in the sizing process. In the rewinding process, a spacer such as a rod is inserted between vertically divided sheets of the warp yarns to prevent snarling. Since the warp yarns cannot be distinguished from reed dent to reed dent, it has been difficult to insert the spacer. According to the present invention, the reed in the sizing process is displaced transversely of the warp yarns to gather the at least two warp yarns in each reed dent into a seeming single strand, and a lease thread is inserted between vertically spaced groups of the warp yarns.

4 Claims, 7 Drawing Figures

METHOD OF TREATING WARP YARN ENDS IN A SIZING PROCESS

BACKGROUND OF THE INVENTION

1. Field of the Invention

The present invention relates to a method of treating warp yarn ends in a sizing process for allowing a sheet of warp yarns unwound from a single beam to be easily separated into sheets of warp yarns as if they were unreeled from at least two beams when the warp yarns are to be rewound onto a beam.

2. Description of the Prior Art

To avoid entangled yarns and facilitate yarn separation in the process of sizing warp yarns for textile fabrics, it is customary to spread 1,000 to 2,000 warp yarns in transversely spaced relation, size and dry the warp yarns thus spaced at a low density, and then wind the warp yarns on a beam in a width substantially equal to that of a fabric to be woven of the warp yarns. As many warp yarns as required are then unreeled from a plurality of such beams and superposed vertically while being rewound onto a single let-off beam in a loom in a width which is the same as the reeding width.

Where the warp yarns are being rewound at a high density onto the let-off beam, a plurality of such warp yarns are threaded into one reed dent to maintain the desired reeding width. However, since the warp yarn ends are not divided into groups to be inserted respectively through the reed dents, it has been quite tedious and time-consuming to thread the warp yarns through the reed dents. The rewinding process employs a lease rod for separating the warp yarns vertically to prevent yarn snarling. The lease rod is required to be inserted alternately over and under the warp yarns to keep them orderly. However, with the warp yarns as sized being not divided for separation in the lease, the lease rod cannot easily be inserted in position.

SUMMARY OF THE INVENTION

It is an object of the present invention to provide a method of treating warp yarn ends in a sizing process for allowing a sheet of warp yarns unwound from a single beam to be easily separated into sheets of warp yarns as if they were unreeled from at least two beams when the warp yarns are to be rewound onto a beam.

To achieve the above object, a reed is displaced transversely of a sheet of warp yarns as they have been sized to gather a plurality of warp yarns in each reed dent into a seeming single strand, and then the warp yarns as thus gathered into separate strands are fixed by an adhesive tape applied to a surface of the warp yarn sheet.

A lease thread is inserted between vertically separated groups of the warp yarns in the sizing process. When the sized warp yarns are to be rewound onto a let-off beam, the warp yarns are divided by the lease thread into the groups, so that a spacer can easily be inserted in place of the lease thread for separating the warp yarns.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
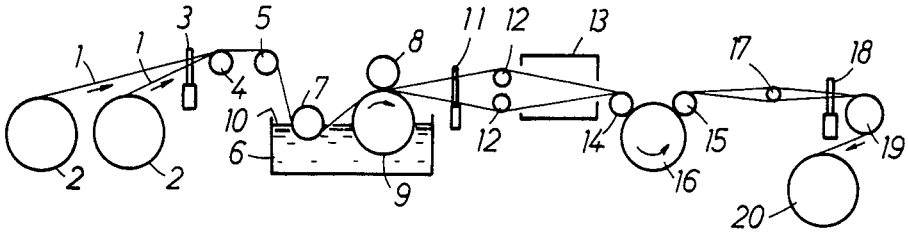
FIG. 1 is a schematic side elevational view illustrative of a sizing process.

FIG. 1 is illustrative of a process of sizing a multiplicity of warp yarns 1. The warp yarns 1 are unreeled in the form of sheets from two sizing beams 2, 2, for example, and pass through a reed 3 at a rough yarn density and as a combined sheet through guide rolls 4, 5. While the warp yarns 1 are being fed around a sizing roll 7 in a sizing bath 6 and between press rolls 8, 9, the warp yarns 1 are immersed in a sizing solution 10 in the sizing bath 6 and sized with the sizing solution 10 applied at an appropriate ratio. The sized warp yarns 1 are fed through a reed 11 and vertically separated by separator rolls or rods 12 into two sheets from the beams 2, 2. The sheets of warp yarns 1 then go through a drying chamber 13 and are caused by guide rolls 14, 15 to be held as one sheet against an outer peripheral surface of a drying roll 16. The completely dried warp yarns 1 are separated again by a separator rod 17 and pass through a reed 18 having a width substantially equal to the reeding width, two warp yarns being threaded through each reed dent in the reed 18. The separated warp yarns 1 are thereafter combined into one sheet by a guide roll 19 and wound onto a takeup roll 20 in a width which is the same as the reeding width.

Figure 2:
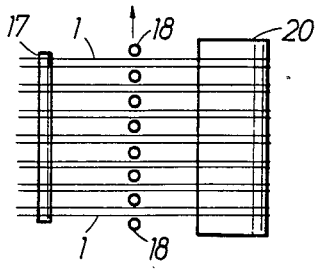
FIG. 2 is a plan view of a separator rod, a reed, and a takeup beam, showing a plurality of warp yarns passing through the separator rod and the reed and wound onto the takeup beam.

The separator rod 17 serves to vertically separate the sheet of warp yarns 1 into two sheets. The vertically separated sheets of warp yarns 1 pass through the reed 18 with two warp yarns threaded through each reed dent to control the width at which the warp yarns 1 will be wound onto the takeup roll 20. If the reed 18 were positionally fixed with respect to the separator rod 17 and the guide roll 19, the warp yarns 1 would be wound onto the takeup roll 20 in transversely equally spaced relation as shown in FIG. 2. If the ends of the warp yarns 1 thus transversely spaced were fixed to an outer peripheral surface of the takeup beam 20, the warp yarns 1 threaded through one reed dent could not be distinguished from those warp yarns 1 extending through other reed dents.

Figure 3:
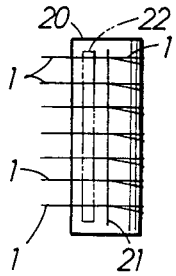
FIG. 3 is a plan view of the takeup beam with warp yarn ends treated thereon.

According to the present invention, the reed 18 is displaced transversely of the warp yarns 1 in the direction of the arrow in FIG. 2 at the end of the sizing process, so that the warp yarns 1 in each reed dent are transversely gathered into a seeming single strand as shown in FIG. 3. Therefore, gathered warp yarn strands that are half as many as the total warp yarns 1 wound on the takeup beam 20 are disposed on the takeup beam 20. A lease thread 21 is inserted between the vertically separated groups of warp yarns 1 for distinction between the warp yarn groups as vertically separated by the separator rod 17 at the ends of the warp yarns on the takeup beam 20. The warp yarn ends as thus grouped into the strands and vertically separated by the lease thread 21 at the end of the sizing process are then fixed relatively to each other by an adhesive tape 22. The fixed warp yarns 1 are then fed to the takeup beam 20, temporarily fixed to an outer peripheral surface of the coiled warp yarns 1 of the takeup beam 20, and then cut off.

Figure 4:
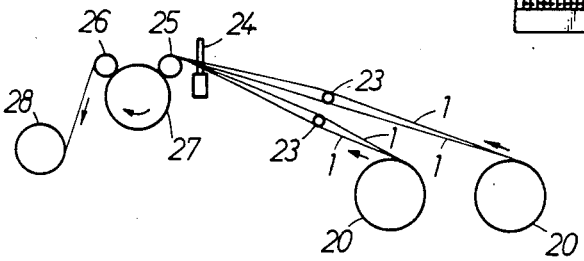
FIG. 4 is a schematic side elevational view showing a process for rewinding sized warp yarns onto a let-off beam.
Figure 5:
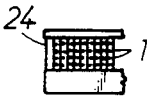
FIGS. 5, 6 and 7 are fragmentary front elevational views of different reeds.

FIG. 4 is illustrative of a process of rewinding the warp yarns 1 after the sizing process. In the rewinding process, there are provided as many takeup beams 20, two for example, as required for supplying a total number of warp yarns dependent on the reeding width and the density of the warp yarns to be woven. The warp yarns 1 are vertically separated by spacers 23 such as rods and then pass through the dents of a reed 24. The warp yarns 1 as they leave the reed 24 are guided by guide rolls 25, 26 to travel around a rewind roll 27 and then wound onto a let-off beam 28 in a loom at a predetermined reeding width and warp density. Since four warp yarns 1 are threaded through each reed dent in the reed 24 in vertically spaced relation as illustrated in FIG. 5, the warp yarns 1 are separated as if they were drawn from four beams 20.

The spacer 23 serves to separate the warp yarns 1 vertically for preventing snarling of the warp yarns 1 in the rewinding process and to allow the warp yarns 1 to be threaded through each reed dent in the reed 24 in vertically spaced relation.

In the rewinding process, the ends of the warp yarns 1 are required to be threaded two yarns through one reed dent in the reed 24 for each beam 20. Since two such warp yarns have been gathered into a seeming single strand in the sizing process, these warp yarns can easily be threaded through the corresponding reed dent in the reed 24. The lease thread 21 inserted between the groups of warp yarns 1 on each beam 20 can be used as a guide for inserting the spacer 23 in place of the lease thread 21, so that the warp yarns remain separated in the same manner as they have been separated in the sizing process. The spacer 23 can be threaded with utmost ease without imparing the vertically separated relationship of the warp yarns 1 which has been attained in the sizing process. Since in the rewinding process the warp yarns 1 can be threaded through the reed 24 and the spacer 23 can be inserted in place of the lease thread 21 highly efficiently without disturbing the separated arrangement of the warp yarns 1 in the sizing process, warp yarns can be sized and rewound at a high warp density with high efficiency.

Figure 6:
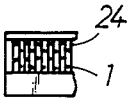
Figure 7:
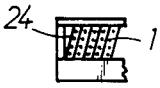

In the foregoing embodiment, the warp yarns 1 are threaded through the reeds 11, 18, 24 in vertically spaced relation but horizontally aligned relation. However, the warp yarns 1 may be vertically spaced but horizontally staggered between adjacent reed dents in a reed 24 as shown in FIG. 6. Alternatively, the warp yarns 1 may be threaded through inclined reed dents in a reed 24 as illustrated in FIG. 7. The spacer 23 may comprise a rod or one or more rotatable rollers.

With the present invention, a reed is displaced transversely of a plurality of warp yarns as sized to gather warp yarns in each reed dent into a seeming single strand. This allows the warp yarns to be easily threaded into the reed dents in a reed in a subsequent rewinding process. Since a lease thread is inserted between separated groups of the warp yarns in the sizing process, a spacer can easily be inserted in place of the lease thread in a rewinding process while maintaining the vertically separated relationship of the warp yarns that has been achieved in the sizing process. Accordingly, the warp yarns as sized even if they are arranged at a high warp density can efficiently be rewound while keeping them arranged as desired.

Although certain preferred embodiments have been shown and described, it should be understood that many changes and modifications may be made therein without departing from the scope of the appended claims.

What is claimed is:

1. A method of treating warp yarn ends in a sizing process, in which warp yarns are sized at a low warp density, threaded through a reed, and then wound on a takeup beam in a width substantially equal to the reeding width in a loom, and in which a selected plurality of takeup beams as required to provide a total number of warp yarns are prepared and arranged in tandem relation for rewinding the warp yarns from the plurality of takeup beams onto a single let-off beam, wherein the improvement comprises the steps of threading the sized warp yarns through the reed with at least two warp yarns in each reed dent, displacing said reed transversely of said warp yarns to gather said at least two warp yarns in each reed dent into a seeming single strand at the end of the sizing step, inserting a lease thread between vertically separated sheets of the warp yarns prior to winding thereof on a single said takeup beam, applying an adhesive tape to ends of the warp yarns, and inserting a spacer in place of said lease thread while rewinding the warp yarns from each of said takeup beams onto the single let-off beam for thereby keeping the warp yarns divided as vertically separated sheets so that the warp yarns unwound from each said takeup beam will appear as if unwound from at least two beams.

2. A method according to claim 1, wherein said warp threads as rewound from each said takeup beam onto said let-off beam are threaded through a reed with at least two warp yarns passing through each reed dent in vertically spaced relation, but in horizontally aligned relation between adjacent reed dents.

3. A method according to claim 1, wherein said warp threads as rewound from said takeup beams onto said let-off beam are threaded through a reed having inclined reed dents with at least two warp yarns passing through each reed dent in vertically spaced relation.

4. A method of treating warp yarn ends in a sizing process for allowing the yarns to be rewound from a plurality of takeup beams onto a single let-off beam, comprising the steps of:

feeding a plurality of horizontally-spaced yarns into and through a sizing solution;

effecting vertical displacement of at least some of the sized yarns relative to the remaining sized yarns to define vertically separated sheets of sized yarns;

feeding the vertically separated sheets of sized yarns into and through a reed such that at least two sized warp threads as disposed in vertically spaced relationship extend through each reed dent;

deflecting at least one of the warp yarns as passing through each reed dent horizontally sidewardly toward the other warp yarn which passes through the respective reed dent to gather said two warp yarns in each reed dent into a seemingly single yarn strand;

inserting a lease thread between the vertically separated sheets;

applying an adhesive tape to the strands adjacent the ends thereof for positionally fixing the strands relative to one another;

winding the strands around a single takeup beam;

providing a plurality of said takeup beams each having a plurality of said strands wound therearound;

supplying the plurality of strands from each of said takeup beams to a common reed;

replacing the lease thread associated with the plurality of strands as withdrawn from each said takeup beam with a separator for effecting vertical separation of the two yarns which define each said strand after the strand has been withdrawn from the respective takeup beam, so that the separated warp yarns are supplied to the common reed and provide a function which appears as if the yarns were unwound from at least two said takeup beams; and supplying the separated yarns from the common reed to a single let-off beam for rewinding thereon.

* * * * *